US005775575A

United States Patent [19]

Dorman et al.

[11] Patent Number: 5,775,575

[45] Date of Patent: Jul. 7, 1998

[54] BOX HAVING FLAP RETAINERS

[75] Inventors: John G. Dorman, Holland; Russell O. Blanchard, Zeeland, both of Mich.

[73] Assignee: Batts, Inc., Zeeland, Mich.

[21] Appl. No.: 660,705

[22] Filed: Jun. 6, 1996

[51] Int. Cl.[6] ..... B65D 43/24

[52] U.S. Cl. ..... 229/125; 229/157

[58] Field of Search ..... 229/125, 155, 229/156, 157, 158

[56] References Cited

U.S. PATENT DOCUMENTS

| | | | |
|---|---|---|---|
| 2,426,484 | 8/1947 | Buffenbarger | 229/125 X |
| 4,884,741 | 12/1989 | Nederveld | 229/157 |
| 5,104,035 | 4/1992 | Rosenbaum, II | 229/157 |
| 5,139,196 | 8/1992 | Fry et al. | 229/157 |
| 5,562,246 | 10/1996 | Smith et al. | 229/125 X |

FOREIGN PATENT DOCUMENTS

| | | | |
|---|---|---|---|
| 2660623 | 10/1991 | France | 229/125 |

*Primary Examiner*—Allan N. Shoap
*Assistant Examiner*—Christopher J. McDonald
*Attorney, Agent, or Firm*—Baker & McKenzie

[57] ABSTRACT

A tote box intended for use in very confined locations such as under the counter of the cashier station in a retail clothing establishment, the box having four flaps, each of which has a tab formed in the center of the edge of the flap. Each wall to which the flap is attached has a gripping aperture into which the tab carried by the flap may be inserted while the box is in use. In addition, a bend line provided between the flap-wall junction and the tab means enables the portion of the flap containing the tab means to be easily inserted into the gripping aperture. Further, a slot in each of two opposing end walls functions to receive and restrain the exterior flap of the two flanking flaps.

16 Claims, 2 Drawing Sheets

BOX HAVING FLAP RETAINERS

This invention pertains generally to cartons of the type formed, usually, from box board or other relatively thin and bendable material similar thereto which can be manufactured in flat form, shipped flat to a site of use, and there formed into a carton open at the top when the top-forming portions are in a free, unassembled condition. The invention pertains specifically to the type of carton above described in which the usefulness of the carton in the above-described open top condition is increased, firstly, by the provision of means formed solely within the carton itself for positively restraining those portions intended to eventually form the top in close juxtaposition to the sides of the carton, and, secondly, by the provision of means for engaging the top flap portions forming the top to one another in a relationship which positively restrains said top flap portions from separating following engagement with one another, utilizing solely the special configuration of the top flap portions. The invention further pertains to a carton as above described which is suitable for tote use in which the means for restraining the top flap portions against separation also provide the function of reinforcing the gripping openings at each end of the carton to form the primary gripping locations for a user's hand/fingers, thereby cushioning the end wall portions above each gripping opening forming the top of said opening from being crushed by forces exerted on said portion by the user's hand as the loaded container is toted following loading.

BACKGROUND OF THE INVENTION

Tote boxes are used in a range of environments which require different structural features of the box. Some tote boxes are used in environments which have substantial open space in the use area and hence a need to have the boxes placed closely next to one another with the flaps, which eventually form the top of the box, restrained in a downwardly directed position is not especially acute. A typical such use would be tote boxes intended to be used on an individual basis by a home dweller, such as when a home dweller decides to put excess books in a living area into a tote box and carry it to the attic. Usage of such boxes in the commercial moving industry is another example. A commercial mover, for example, may provide a home dweller about to move residences with a plurality of tote boxes, and the user may place two or more, usually less than all, of said tote boxes in each of several rooms to hold objects, often numerous small objects, in each specific room. Indeed, in some instances the home dweller is forced to overload the boxes in the sense that the additional storage space provided by the ends and side flaps, which are designed to form the top, must be used in an upright position since too few boxes may have been provided for the volume of objects to be loaded and transported.

Other tote boxes are used in environments in which the space available to hold the box is very limited. In addition, in such environments, the boxes may be used in conjunction with heavy objects which increase the need for additional strength in the high stress areas of the box. A typical such environment is the usage of tote boxes on the sales floor of a retail clothing establishment.

Thus, in a men's or women's suit department of a retail clothing establishment, the sales procedure may require the retail clerk, after making a sale of a suit, to take the just sold garment off the hanger on which it was displayed on the sales rack in the selling area and toss the just separated hanger into a tote box located beneath the counter at the sales register. As is well known, the space allocated to the sales write up and cashier's functions is very limited since modern merchandising pressures dictate that the maximum square footage of available space be dedicated to the display of goods. As a consequence the space for the carton, usually a tote box, beneath the counter will be very limited, and sometimes only an inch or two, or even just a fraction of an inch, clearance on all sides for the box may be available. As a consequence, due to the limited width and depth of the tote box receiving area and the equally limited space vertically above the box, the box cannot have its top flap portions project upwardly, nor perpendicularly outwardly, from the sides of the box while in an open, loading condition. In essence it is a functional necessity that the top flaps, in use, be easily oriented in a downward direction and easily and positively connected to the respective end walls and side walls of the box so that such a use-ready box can be quickly put in the above described use-ready condition by the skill level of personnel used in the retail establishments. Thus, with respect to a loaded box, it is essential that the box be (i) able to be smoothly pulled out from its use position by a pulling force exerted on one end only of the loaded box, (ii) lifted onto a cart or other transporting vehicle by a quick upward jerk on the fingerholds in the ends of the box, (iii) quickly closed by folding end wall and side wall flaps over one another to form a top and easily securing said flaps to one another to hold them in a closed top condition, and, further, that, with respect to an unloaded box, (iv) the end and side flaps which form the top must be quickly and easily bent downwardly and secured to the side walls and end walls in close juxtaposition thereto so that the unloaded box may be easily slid into the small space under the counter dedicated to receiving the box.

While one, and in some instances two of these functions can be found in prior art constructions, the provision of all of these functions in a conventional stamped, boxboard flat tote box blank has not been accomplished in a single, low cost construction.

SUMMARY OF THE INVENTION

The invention is a tote box for heavy loads especially adapted to be quickly, easily and simply folded into a filling condition in which the top flaps, which are secured to the tops of the ends and side walls, are positively restrained against upwardly or outwardly orientation with respect to the balance of the box while, at the same time, some or all of the thus restrained flaps are associated with finger grip apertures in the walls of the box to reinforce said apertures during the entire period of time the box is open during use. The invention further includes, in combination with the foregoing, restraining slots formed in selected top flaps which receive and positively restrain other top flaps when the box is closed, all of the foregoing being formed from a one piece box blank.

BRIEF DESCRIPTION OF THE DRAWING

The invention is illustrated more or less diagrammatically in the accompanying drawing in which.

DETAILED DESCRIPTION OF THE INVENTION

Figure 1:
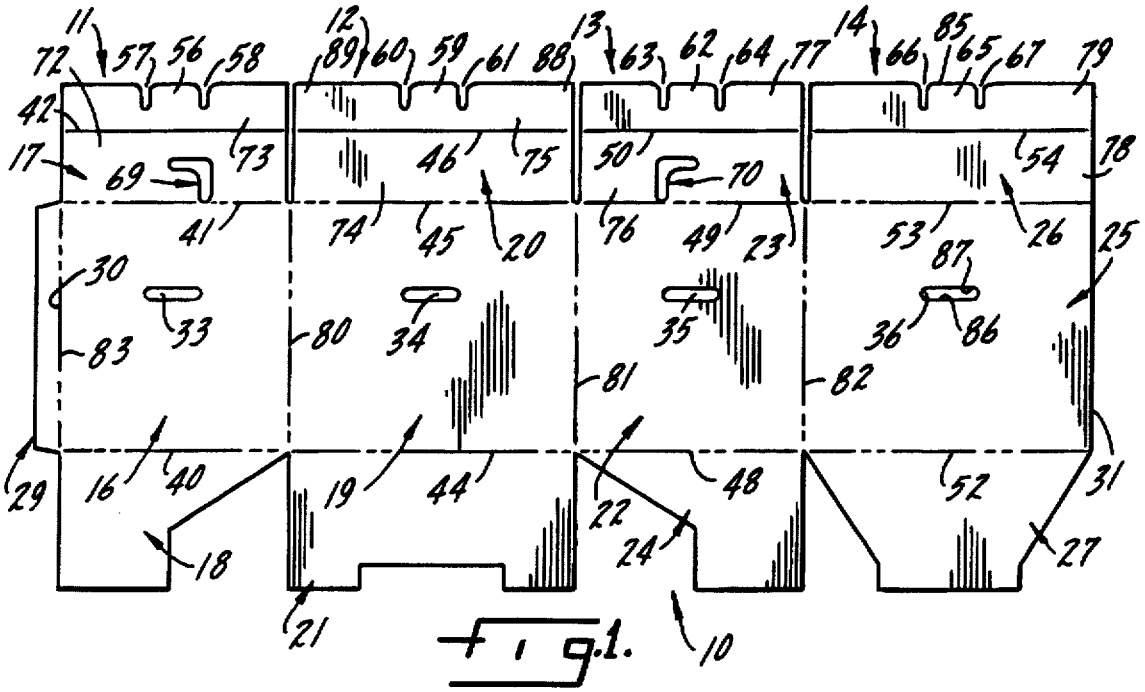
FIG. 1 is the blank from which the tote box of this invention is formed.

The invention will be described in conjunction with the Figures of the drawing in which like reference numerals will be used to refer to like or similar parts from Figure to Figure in the drawing.

A tote box carton blank is indicated generally at 10 in FIG. 1. The blank is formed, by conventional die cutting and scoring, into two end/bottom sections and two side/bottom sections indicated generally at 11, 12, 13 and 14. Each of said end/bottom and side/bottom sections 11–14 has a wall portion, a top flap which forms a portion of the top, and a bottom flap which forms a portion of the bottom. With respect to end/bottom section 11, the wall portion is indicated generally at 16, the top flap at 17 and the bottom flap at 18. Similar wall, top flap and bottom flap are indicated generally at 19, 20 and 21 for side/bottom section 12, at 22, 23 and 24 for end/bottom section 13, and at 25, 26 and 27 for side/bottom section 14. A junction closure flap is indicated generally at 29 whose purpose is to form a closed junction where the vertical edge 30 of end wall 16 and the vertical edge 31 of side wall 25 meet. Said closure flap may have means for adhering itself to side wall 25, such as adhesive material which may be pressure activated, but such is not a necessity. Finger grips are indicated at 33, 34, 35 and 36.

A scored junction line is indicated at 40 between end wall 16 and bottom flap 18, and another scored junction line is indicated at 41 between end wall 16 and top flap 17. A scored bend line in top flap 17 is indicated at 42.

A scored line is indicated at 44 between side wall 19 and bottom flap 21, and another scored junction line is indicated at 45 between side wall 19 and top flap 20. A scored bend line in top flap 20 is indicated at 46.

A scored junction line is indicated at 48 between end wall 22 and bottom flap 24, and another scored junction line is indicated at 49 between end wall 22 and top flap 23. A scored bend line in top flap 23 is indicated at 50.

A scored junction line is indicated at 52 between side wall 25 and bottom flap 27, and another scored junction line is indicated at 53 between side wall 25 and top flap 26. A scored bend line in top flap 26 is indicated at 54.

A tab 56 is formed in top flap 19 by two notches 57, 58. Similar tabs and notches are indicated at 59, 60 and 61 in top flap 20, at 62, 63 and 64 in top flap 23, and at 65, 66 and 67 in top flap 26.

A first, generally L-shaped flap lock notch is indicated generally at 69 and another similar flap lock notch is indicated generally at 70.

As best seen in FIG. 1, bend line 41 divides end wall top flap 17 into an inner panel 72 and an outer panel 73. In similar fashion bend line 46 divides side wall top flap 20 into an inner panel 74 and an outer panel 75, bend line 50 divides end wall top flap 23 into an inner panel 76 and an outer panel 77, and bend line 54 divides side wall flap 26 into an inner panel 78 and an outer panel 79.

Figure 2:
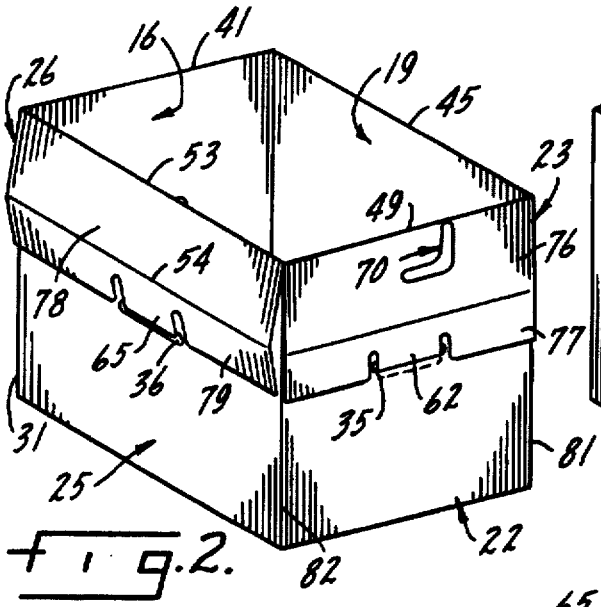
FIG. 2 is a perspective view of the blank of FIG. 1 formed into a use ready condition.

Referring now to FIG. 2 it will be seen that the carton blank 10 of FIG. 1 has been folded along junction line 80 between end wall 16 and side wall 19, along junction line 81 between side wall 19 and end wall 22, along junction line 82 between end wall 22 and side wall 25, and along junction line 83 between closure flap 29 and end wall 16. The bottom flaps 18, 21, 24 and 27 have also been bent along their junction lines 40, 44, 48 and 52 respectively to form a closed bottom which is not visible in FIGS. 1–3. Top end wall flap 17 has been bent 180° about its junction line 41, top side wall portion 20 has been bent 180° about its junction line 45, top end wall flap 23 has been bent 180° about its junction line 49 and top end wall 26 has been bent 180° about its junction line 53.

Figure 4:
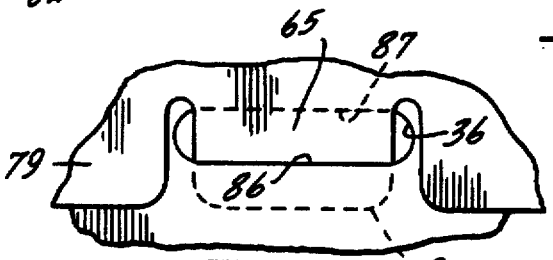
FIG. 4 is a detail view to an enlarged scale as contrasted to the scale of FIGS. 1–3 of the finger grip portion of the tote box in the opened condition of FIG. 2.

The unique flap restraining concept is shown best in connection with top side wall flap 26 and top end wall flap 23 in FIG. 2. Referring first to side wall top flap 26, it will be seen that inner panel 78 and outer panel 79 have been bent along their mutual bend line 54 in such fashion that inner panel 78 is inclined mostly downwardly but very slightly outwardly, and outer panel 79 is inclined mostly downwardly but very slightly inwardly towards side 25. The inwardly directed orientation of panel 79 presents side wall tab 65 in overlapping relationship with finger grip 36. Since the components are dimensioned so that the outermost edge 85 of tab 65 is spaced a greater distance from junction line 53 that either the top 86 or bottom 87 horizontal edges of finger grip 36, tab 65 will pass into finger grip 36 and come to rest behind and downwardly spaced from the bottom edge 87 as clearly seen in FIG. 4.

Figure 3:
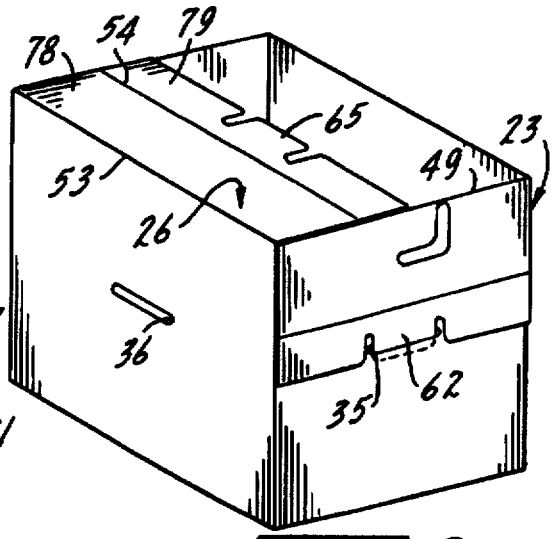
FIG. 3 is a perspective view of the tote box of this invention illustrating the first step in the closing process after objects to be stored/transported have been placed in the FIG. 2 condition of the box.

Referring now to FIG. 3 it will be seen that top flaps 17, 20 and 23 have remained in their positions of FIG. 2 with respect to their associated wall portions. That is, Tab 62 has remained engaged with its complementary finger grip 35, and tabs 56 and 59 of top end and top side wall portions 17 and 20 have remained similarly engaged with their associated finger grips 33, 34, (not shown in FIG. 3).

However, top flap 26 has been bent 270° from its FIG. 2 position around junction line 53, tab 65 having been removed from finger grip 36. This is the first movement in the closing sequence, although it will be appreciated that the same closing movement could be done with top flap portion 20 instead of top flap portion 26, assuming reversal of flap lock notches 69, 70.

Figure 5:
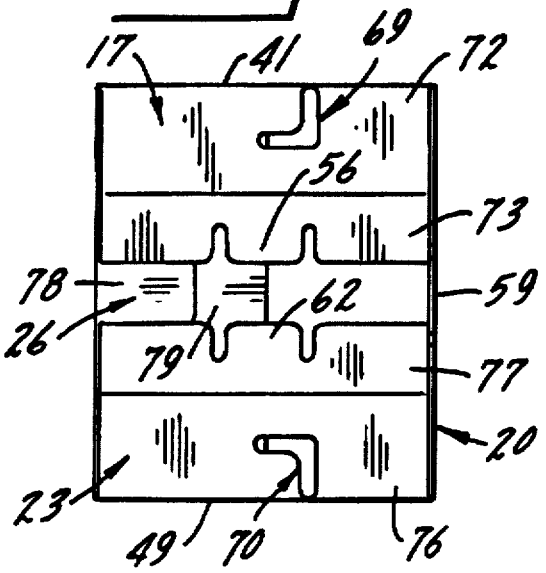
FIG. 5 is a top plan view of tote box in a subsequent step in the closing process as compared to FIG. 3, said step showing one side wall flap and the two end wall flaps closed to their final position.

Referring now to FIG. 5, it will be seen that top end wall flap 23 has been bent 270° about its junction line 49 to lie flat on top of side wall top flap 26. In similar fashion, top end wall flap 17 has been bent 270° about its bend junction line 41 to also lie flat on top of side wall top flap 26. It will be noted, however, that side wall top flap 20 has been bent around its junction line only 180° and thus extends vertically upright as viewed in FIG. 5.

Figure 6:
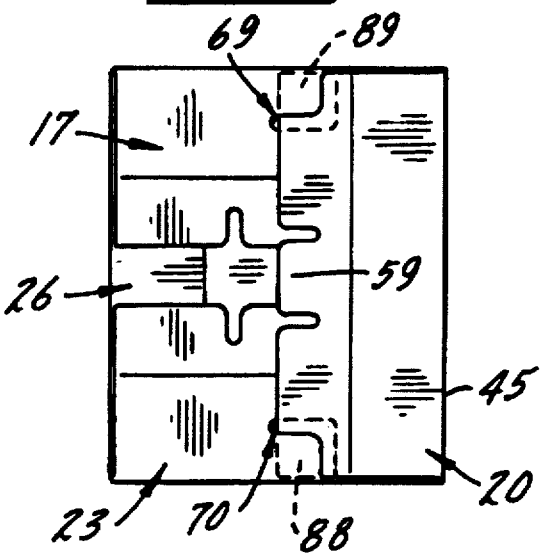
FIG. 6 is a top plan view of the tote box in a fully closed position.

Finally it will be noted from FIG. 6 that side wall top flap 20 has been bent an additional 90° about its junction line 45 as compared to its FIG. 5 position, and now overlies the right half portions of each of end wall top flap 17 and end wall top flap 23. It will be noted, however, that the upper right corner tip 88 of end wall top flap 20 and the upper left corner tip 89, see also FIG. 1, of end wall top flap 20 have been tucked into L-shaped flap lock notches 69, 70, respectively to secure the side wall top flap 20 to the underlying end wall top flaps 17 and 23. These three top flap portions overlie and thereby restrain the other side wall top flap 26 against movement in a box opening direction.

It will thus be seen that when the tote box 10 is erected from its blank condition of FIG. 1 into a container as shown in FIG. 2, the tab finger grip combinations 56, 33 and 59, 34 and 62, 35 and 65, 36 maintain the top flap portions 17, 20, 23 and 26, respectively, in closed juxtaposition to their associated vertical walls 16, 19, 22 and 25 respectively so that the box, in a fully opened ready for use condition, can be slid into, and, when loaded, slid out from, a space only a fraction of an inch greater in all directions than the outside dimensions of the box. If desired, bend lines 41, 45, 49 and 53 may be utilized to make easier the insertion of tabs 56, 59, 62 and 65 into finger grips 33, 34, 35 and 36 respectively.

A further highly advantageous feature of the invention is that each of tabs 56, 59, 62 and 65 extend a substantial distance downwardly below the upper horizontal edge 86 of finger grip 36 so that, when the user wishes to grab the loaded box and pull it from its use position and, possibly, thereafter pull or jerk it upwardly to be placed on a transport vehicle, such as a hand truck, and further handled and unloaded with the same motions, tab 65 will, by virtue of the inward pushing force of the fingers of the user as the user commences to grasp the box to manipulate it, bend upwardly around the upper edge 86 of the finger grip 37. This bending of tab 65 precludes the possibility of the substantial, and somewhat concentrated, upward forces exerted by the fingers of the user on the upper edge 86 of the finger grip from tearing or otherwise deforming the material surrounding the grip. In effect, a finger hold three layers thick, with the two outside layers presenting the smooth contour of the outside of a U, are exposed to a user's hand as a handle. It will also be appreciated that this configuration is much more comfortable to the hand than if hand would be required to lift upwardly on the cut edges of a single thickness of the box material.

It will also be noted that since all manipulations of the box are simple bending motions or, in the case of the upper corners 88 and 89 of end wall top flap 20, a simple sliding motion, the box is both easy and simple to use by personnel of all skill levels, including the skill level often found in the service departments of retail establishments.

Although a current form of the invention has been illustrated and described, it will be appreciated that variations may be made within the spirit and scope of the invention. Accordingly, it is intended that the scope of the invention be limited not by the scope of the foregoing description but solely by the scope of the hereafter appended claims when interpreted in light of the relevant prior art.

I claim:

1. A box comprising:

a plurality of enclosing walls, a bottom, a flap extending from the upper end of one of said walls, said flap being connected to said one wall by a bend line at the junction between said flap and wall, said flap having an outermost edge located distally from the junction between said flap and wall, a gripping aperture in said one wall, a tab formed in said flap, said tab being defined by notches formed in the outermost edge of the flap and being formed in said flap in a location such that, when the flap is bent outwardly about its junction bend line to an open condition said tab is aligned with, and is directable by hand/finger pressure into the gripping aperture in said one wall whereby said flap, when the box is in the open condition, is positioned closely adjacent the exterior surface of said one wall to thereby occupy a minimum space beyond the exterior surface of said one wall.

2. The box of claim 1 further characterized in that at least two of said walls each has a flap extending from the upper end of its associated wall junction bend between each said flap and its associated wall, and in that each of said walls from which a flap extends has a gripping aperture therein, the tab in each said flap being aligned with the gripping aperture in the wall from which said flap extends, whereby each of said flaps, when the box is in the open condition, is positioned closely adjacent the exterior surface of its associated wall to thereby occupy a minimum space beyond the exterior surface of said associated wall.

3. The box of claim 2 further characterized in that said tab extends downwardly below the upper edge of its associated gripping aperture a distance sufficiently able to be easily bent by hand/finger pressure under the upper edge of said gripping aperture to thereby provide an enlarged comfortable gripping surface to the hand of a user.

4. The box of claim 2 further characterized in that said box has four enclosing walls.

5. The box of claim 4 further characterized in that said box is rectangular in shape, a first pair of said walls being spaced from one another and parallel to one another and a second pair of walls are being spaced from one another and parallel to one another, and in that each flap extending from its associated wall has a bend line at its junction with its associated wall, and a tab, and in that each wall has a gripping aperture, and in that the tab in each said flap is aligned with the gripping aperture in the wall from which said flap extends, whereby each of said flaps, when the box is in the opened condition, is positioned closely adjacent the exterior surface of its associated wall to thereby occupy a minimum space beyond the exterior surface of said associated wall.

6. The box of claim 5 further characterized in that each of two flaps in a first pair of opposed flaps includes means for receiving and restraining one of said flaps in a second pair of opposed flaps when said flaps are folded inwardly to overlie the interior of the box to thereby form a cover.

7. The box of claim 6 further characterized in that said receiving and restraining means is a slot, said slot having a portion located near the wall-flap junction line located such that a corner of one flap in said opposite pair of flaps may be received and restrained therein.

8. The box of claim 1 further characterized in that said flap has a bend line located between the tab and the flap-wall junction, said bend line being oriented to direct the portion of the flap containing the tab, and thereby the tab, in a downwardly and inwardly direction toward the wall to thereby facilitate entry of the tab carried by said flap into the gripping aperture in the adjacent wall.

9. The box of claim 8 further characterized in that at least two of said walls each has a flap extending from the upper of its associated wall and a junction-bend line between each said flap and its associated wall, and in that each of said walls from which a flap extends has a gripping aperture therein, the tab in each said flap being aligned with the gripping aperture in the walls from which said flap extends, whereby each of said flaps when the box is in the open condition, is positioned closely adjacent the exterior surface of its associated wall to thereby occupy a minimum space beyond the associated wall.

10. The box of claim 9 further characterized in that said tab extends downwardly below the upper edge of its associated gripping aperture a distance sufficient to be easily bent by hand/finger pressure under the upper edge of said gripping aperture to thereby provide an enlarged, comfortable gripping surface to the user.

11. The box of claim 10 further characterized in that said box has four enclosing walls.

12. The box of claim 11 further characterized in that said box is rectangular in shape, a first pair of said enclosing walls being spaced from one another and parallel to one another, and the second pair of enclosing walls being spaced from one another and parallel to one another, and in that each flap extending from its associated wall has a bend line at its junction with its associated wall, and a tab, and in that each wall has a gripping aperture, and in that the tab in each said flap is aligned with the gripping aperture in the wall from which said flap extends, whereby each of said flaps, when the box is in the open condition, is positioned closely adjacent the exterior surface of its associated wall to thereby occupy a minimum space beyond the exterior surface of said associated wall.

13. The box of claim 12 further characterized in that each of two flaps in a first pair of opposed flaps includes means for receiving and restraining one of said flaps in a second pair of opposed flaps when said flaps are folded inwardly to overlie the interior of the box to thereby form a cover.

14. The box of claim 13 further characterized in that said receiving and restraining means is a slot, said slot having a portion located near the wall-flap junction line so oriented that a corner of one flap in said opposite pair of flaps may be received and retained therein.

15. The box of claim 8 further characterized in that said bend line located between the tab and the flap-wall junction extends the full width of the flap.

16. The box of claim 15 further characterized in that said bend line located between the tab and the flap-wall junction is positioned such that it does not contact the tab.

* * * * *